United States Patent [19]

Kamegasawa et al.

[11] Patent Number: 5,076,063

[45] Date of Patent: Dec. 31, 1991

[54] REFRIGERANT PROCESSING AND CHARGING SYSTEM

[75] Inventors: Masao Kamegasawa, Isesaki; Keiichi Tomaru, Fujioka, both of Japan

[73] Assignee: Sanden Corporation, Gunma, Japan

[21] Appl. No.: 454,642

[22] Filed: Dec. 21, 1989

[30] Foreign Application Priority Data

Dec. 22, 1988 [JP] Japan ..... 63-322160
Dec. 22, 1988 [JP] Japan ..... 63-322164

[51] Int. Cl.[5] ..... F17C 3/10

[52] U.S. Cl. ..... 62/48.2; 62/149; 62/174; 62/197; 62/292

[58] Field of Search ..... 62/149, 174, 197, 292, 62/50.5, 48.2

[56] References Cited

U.S. PATENT DOCUMENTS

| | | | |
|---|---|---|---|
| 3,037,362 | 6/1962 | Tilney et al. | 62/117 |
| 3,112,617 | 12/1963 | Hashemi-Tafreshi | 62/48.2 |
| 3,527,379 | 9/1970 | Mair | 62/48.2 |
| 3,564,865 | 2/1971 | Spencer et al. | 62/197 |
| 3,695,055 | 10/1972 | Bruce | 62/292 |
| 3,932,154 | 1/1976 | Coers et al. | 62/50.5 |
| 4,476,688 | 10/1984 | Goddard | 62/292 |
| 4,539,817 | 9/1985 | Staggs et al. | 62/292 |
| 4,633,674 | 1/1987 | Sato | 62/197 |
| 4,856,289 | 8/1989 | Lofland | 62/292 |
| 4,856,290 | 8/1989 | Rodda | 62/292 |

*Primary Examiner*—Ronald C. Capossela
*Attorney, Agent, or Firm*—Banner, Birch, McKie & Beckett

[57] ABSTRACT

For use in processing an object refrigerant produced from an original refrigerant, a refrigerant processing system comprises a separating unit (18, 20, and 22) for separating the original refrigerant into a gaseous phase refrigerant component and a liquid phase refrigerant component. A first supplying pipe (12*a*) supplies the gaseous phase refrigerant component as the object refrigerant to a liquefying unit (24*a* and 24*b*), which liquefies the object refrigerant into a liquefied object refrigerant by the use of evaporation of a liquid refrigerant. A second supplying pipe (12*b*) supplies the liquid phase refrigerant component to the liquefying unit as the liquid refrigerant. The separating unit comprises a receiving unit (18) for receiving the original refrigerant as a received refrigerant, a condensing unit (20) for condensing the received refrigerant into a condensed refrigerant, and a separation vessel (22) comprising upper and bottom parts defining upper and bottom spaces, respectively. In this case, the upper and the bottom spaces are contiguous to each other to form a hollow space in the separation vessel.

6 Claims, 1 Drawing Sheet

FREEZING CKT
LIQUID FLOW
GASEOUS FLOW
OIL FLOW
11
12
13
14
15
16
17
18
19
20
21
22
22a
22b
12a
12b
12c
23
24a
24b
25
26
27
28
29
30
C
L
S

REFRIGERANT PROCESSING AND CHARGING SYSTEM

BACKGROUND OF THE INVENTION

This invention relates to a refrigerant processing and charging system. More particularly, this invention relates to a system which is of the type described and operable in a self-heat exchanging system.

A refrigerant, such as a fluorocarbon refrigerant, is commonly employed in an air conditioner of an automobile or a refrigerator.

A refrigeration system will operate most efficiently when the refrigerant is made pure and relatively free of pollutants, for example, oil, air and water. But, a used refrigerant becomes impure by pollutants.

Therefore, it is necessary to periodically remove and recharge the refrigerant within the refrigerant system.

Various refrigerant processing and charging system are already known. In the Miyata et al article, a citation is made as regards refrigerant charging system of the type disclosed in Japanese Patent Prepublication (Kookai) No. 251767 of 1988.

Such a refrigerant charging system comprises a liquefying unit which liquefies an object refrigerant into a liquefied object refrigerant in a liquefication vessel by use of an evaporator included in an external freezing circuit or refrigeration circuit. The liquefied object refrigerant is dropped from the liquefication vessel into a storage container by gravitational force, and is thereby charged to the storage container. The object refrigerant is produced from an original refrigerant which is employed in, for example, an air conditioning system. The evaporator, however, is operated by an external freezing circuit. This causes a problem because of the inevitable need for the use of an external freezing circuit to liquefy the object refrigerant.

In addition, it is assumed that the liquefied object refrigerant is not smoothly charged to the storage container until the liquefied object refrigerant is fully accumulated in the liquefication vessel.

SUMMARY OF THE INVENTION

It is therefore an object of the present invention to provide a refrigerant processing and charging system for processing an object refrigerant produced from an original refrigerant to be pure and free of pollutants.

It is another object of this invention to provide a system of the type described, which can do without an external freezing circuit to liquefy the object refrigerant as a liquefied object refrigerant of a liquid phase.

It is still another object of this invention to provide a system of the type described, which is available to charge the liquefied object refrigerant to a storage container.

Other objects of this invention will become clear as the description proceeds.

In accordance with this invention, there is provided a refrigerant processing system for use in processing an object refrigerant produced from an original refrigerant. The refrigerant processing system comprises a liquefying unit for liquefying the object refrigerant into a liquefied object refrigerant by use of evaporation of a liquid refrigerant. The refrigerant processing system further comprises a separating unit for separating the original refrigerant into a gaseous phase refrigerant component and a liquid phase refrigerant component, a first supplying unit coupled to the separating unit for supplying the gaseous phase refrigerant as the object refrigerant to the liquefying unit, and a second supplying unit coupled to the separating unit for supplying the liquid phase refrigerant as the liquid refrigerant to the liquefying unit.

DESCRIPTION OF THE PREFERRED EMBODIMENT

Figure 1:
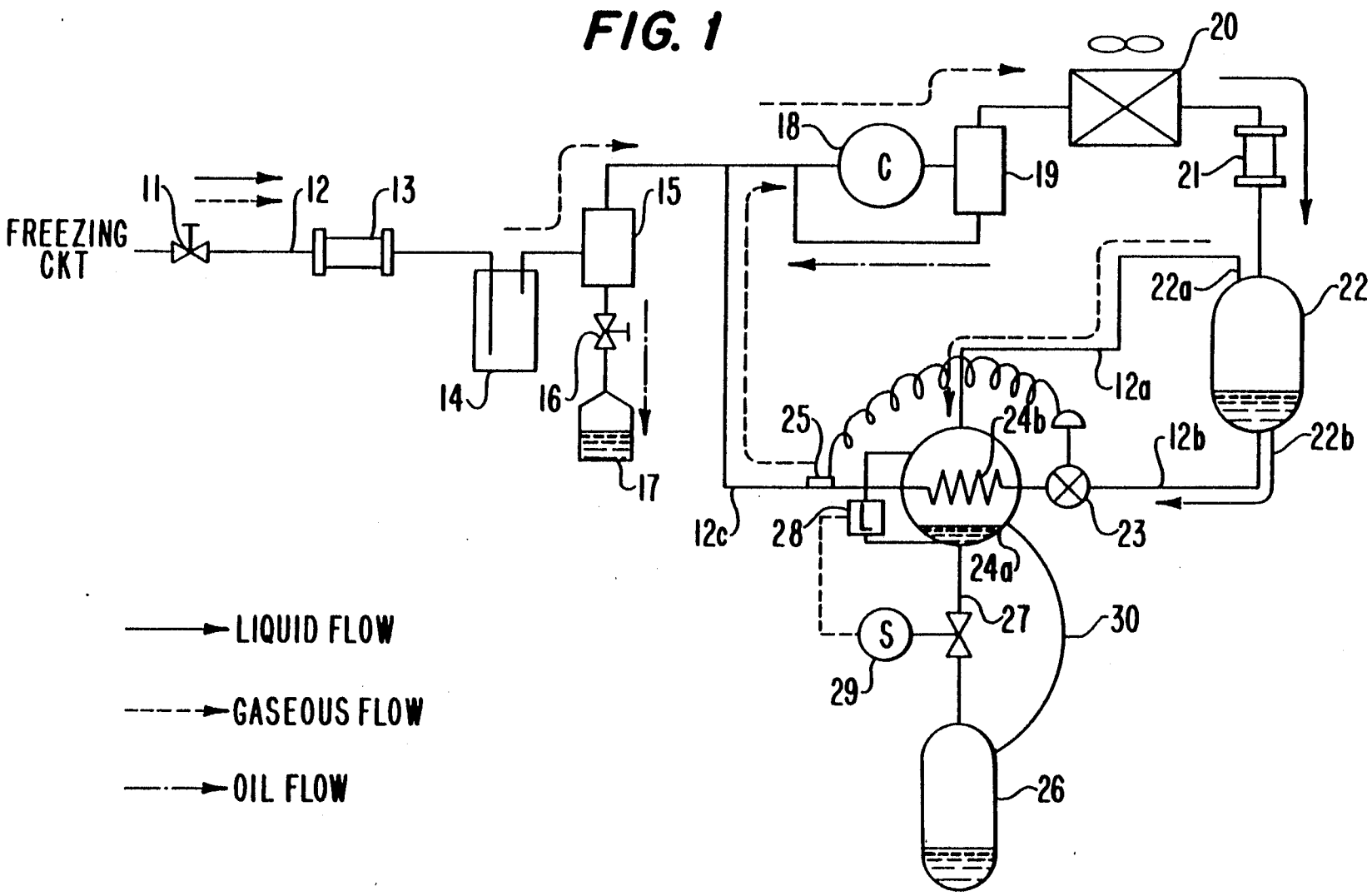
FIG. 1 is a block diagram of a refrigerant processing and charging system according to a first embodiment of this invention.

A refrigerant processing and charging unit according to an embodiment of this invention is of the type described and operable in a self-heat exchanging system which is connected to an air conditioning system of an automobile.

The air conditioning system uses a fluorocarbon refrigerant as an original refrigerant in a freezing circuit (not shown).

Referring to FIG. 1, the refrigerant processing and charging unit comprises an inlet valve 11 which is for introducing the original refrigerant from the freezing circuit. The original refrigerant will be introduced as a liquid phase flow and gaseous phase flow to the refrigerant processing unit.

When the inlet valve 11 is opened for introducing the original refrigerant from the freezing circuit, the original refrigerant reaches a first filter dryer 13. The inlet valve 11 can be disconnected from the freezing circuit. The first filter dryer 13 is for removing impurities, moisture, and acid content from the original refrigerant in the manner known in the art.

An accumulator 14 is connected to the first filter dryer 13 for accumulating the original refrigerant. The liquid phase flow is accumulated in a bottom part of the accumulator 14, and the gaseous phase flow thereon is supplied to a first oil intercepter 15. The first oil intercepter 15 is to intercept an oil element of the original refrigerant. The intercepted oil element is accumulated in an oil tank 17 through an oil valve 16.

The original refrigerant is supplied to a compressor 18 from the first oil intercepter 15. In this event, the original refrigerant is in a gaseous phase.

The gaseous original refrigerant is compressed in the compressor 18 and is supplied as a compressed refrigerant to a condenser 20 through a second oil intercepter 19. The intercepted oil element is accumulated in another oil tank (not shown). In the condenser 20, the compressed refrigerant is cooled to thereby be condensed as a condensed refrigerant. The condensed refrigerant is supplied to a second filter dryer 21 which removes impurities, moisture, and acid content from the condensed refrigerant.

After that, the condensed refrigerant is supplied to a separation vessel 22 and is therein separated into a gaseous phase refrigerant component and a liquid phase refrigerant component.

The separation vessel 22 comprises an upper part and a bottom part defining an upper space and a bottom space, respectively. The upper space and the bottom space are contiguous with each other to form a hollow space in the separation vessel 22. As is well known in the art, the gaseous phase refrigerant component has superior purity in comparison with the liquid phase refrigerant component.

A combination of the compressor 18, the second oil intercepter 19, the condenser 20, the second filter dryer 21, and the separation vessel 22 is referred to as a separating arrangement. A pipe 12 is provided for effecting the connection between the inlet valve 11 and the separation vessel 22.

The separation vessel 22 has a first outlet port 22*a* at an upper portion thereof and a second outlet port 22*b* at a bottom portion thereof. The first outlet port 22*a* is connected to a liquefication vessel 24*a*, by a first supplying pipe 12*a*, to communicate with a thermal space defined by the liquefication vessel 24*a*. Therefore, the gaseous phase refrigerant component is sent as an object refrigerant from the separation vessel 22 to the liquefication vessel 24*a*. On the other hand, the second outlet port 22*b* is connected to an evaporator 24*b* via an automatic expansion valve 23 and a second supplying pipe 12*b*. Therefore, the liquid phase refrigerant component is sent as a liquid refrigerant from the separation vessel 22 to the evaporator 24*b* and is evaporated in the evaporator 24*b* to carry out cooling of a surrounding area of the evaporator 24*b* in a manner known in the art.

The evaporator 24*b* is thermally coupled to the thermal space of the liquefication vessel 24*a*. In this embodiment, the evaporator 24*b* is contained in the liquefication vessel 24*a*. As a result, the gaseous phase refrigerant component is cooled in the liquefication vessel 24*a* by evaporation of the liquid refrigerant, namely, the liquid phase refrigerant component in the evaporator 24*b*. In other words, heat exchange is carried out between the gaseous and the liquid phase refrigerant components. Therefore, the evaporator 24*b* may be referred to as a liquefying arrangement.

After being evaporated in the evaporator 24*b*, the gaseous refrigerant is returned to the compressor 18 through a returning pipe 12*c*.

A temperature detecting unit 25 is thermally coupled to the returning pipe 12*c*. The temperature detecting unit 25 is for detecting the temperature of the gaseous refrigerant at vicinity of the liquefication vessel 24*a* to produce a temperature signal which is representative of the temperature. Responsive to the temperature signal, the automatic expansion valve 23 is automatically driven to adjust the magnitude of the flow of the liquid phase refrigerant component.

The liquefied object refrigerant is collected at a lower portion of the thermal space of the liquefication vessel 24*a*. A storage container 26 is placed under the liquefication vessel 24*a* and is connected to the thermal space by a sending pipe 27. Therefore, the liquefied object refrigerant drips from the liquefication vessel 24*a* towards the storage container 26 through the sending pipe 27 by gravitational force. As a result, the liquefied object refrigerant is charged in the storage container 26. It is a matter of course that the liquefied refrigerant has a relatively higher purity in the storage container 26.

When the thermal space lacks a sufficient quantity of the liquefied object refrigerant, the liquefied object refrigerant is prevented from charging thereof towards the storage container 26.

For controlling the quantity of liquid in the thermal space, a liquid level sensor 28 is connected to the liquefication vessel 24*a*. The liquid level sensor 28 is for detecting a predetermined liquid level. The sensor 28 produces a condition signal which is sent to an electromagnetic valve 29. The electromagnetic valve 29 is coupled to the sending pipe 27. Responsive to the condition signal, the electromagnetic valve 29 is automatically driven to adjust the movement of the liquefied object refrigerant through the sending pipe 27. A combination of the sending pipe 27, the liquid level sensor 28, and the electromagnetic valve 29 is referred to as a control arrangement. It is preferable that the condition signal responsive to the predetermined liquid level be produced until the evaporator 24*b* is made thoroughly wet by the liquefied object refrigerant in the liquefication vessel 24*a*. This arrangement increases the effectiveness of the heat exchange. When the detected liquid level is lower than the predetermined liquid level, the electromagnetic valve 29 is driven in response to the condition signal to stop the dripping of the liquefied object refrigerant to the storage container 26.

When the detected liquid level is higher than the predetermined level, the electromagnetic valve 29 is driven in response to the condition signal to open the sending pipe 27, so that the liquefied object refrigerant flows into the storage container 26. Preferably, a venting pipe 30 is disposed between the liquefication vessel 24*a* and the storage container 26 for venting a residual gas of the refrigerant in the storage container, to thereby achieve a smooth flow of the liquefied object refrigerant through sending pipe 27. Therefore, the effectiveness of the heat exchange is increased in the liquefying arrangement.

The object refrigerant can be smoothly charged into the storage container 26 by a repeat of the operation which is described above.

While the present invention has thus far been described in connection with the embodiment thereof, it is possible for those skilled in the art to readily put this invention into practice in various other manners.

What is claimed is:

1. A refrigerant processing system for use in processing an object refrigerant produced from an original refrigerant, said refrigerant processing system comprising liquefying means for liquefying said object refrigerant into a liquefied object refrigerant by use of evaporation of a liquid refrigerant, wherein the improvement comprises:

receiving means for receiving said original refrigerant;

condensing means coupled to said receiving means for condensing said original refrigerant into a condensed refrigerant;

a separation vessel comprising an upper part and a bottom part defining an upper space and a bottom space, respectively, said upper and said bottom spaces being contiguous to each other to form a hollow space in said separation vessel;

said separation vessel being coupled to said condensing means and supplied with said condensed refrigerant to separate a gaseous phase refrigerant component and a liquid phase refrigerant component from said condensed refrigerant;

first supplying means coupled to said upper part for supplying said gaseous phase refrigerant component as said object refrigerant to said liquefying means; and second supplying means coupled to said bottom part for supplying said liquid phase refrigerant component and said liquid refrigerant to said liquefying means.

2. A refrigerant processing system as claimed in claim 1, wherein said liquefying means comprises:

a liquefication vessel defining a thermal space;

an evaporator thermally coupled to said thermal space;

said liquefication vessel being coupled to said first supplying means to receive said gaseous phase refrigerant component; and said evaporator being coupled to said second supplying means to cause evaporation of said liquid phase refrigerant component.

3. A refrigerant processing system as claimed in claim 1, further comprising a storage container being disposed downward from said liquefying means, and dripping means coupled to said liquefying means and said storage container for dripping said liquefied object refrigerant to said storage container.

4. A refrigerant processing system as claimed in claim 3, further comprising controlling means coupled to said liquefying means for controlling a condition of said liquefied object refrigerant to charge said liquefied object refrigerant to said storage container.

5. A refrigerant processing system as claimed in claim 4, wherein said controlling means comprises:

detecting means coupled to said liquefication vessel for detecting a certain quantity of said liquefied object refrigerant and;

adjusting means coupled to said detecting means and said dripping means and responsive to said certain quantity of said liquefied object refrigerant for adjusting said dripping means.

6. A refrigerant processing system as claimed in claim 5, further comprising breathing means coupled to said storage container for venting a residual gas in said storage container.

* * * * *